United States Patent [19]

Will

[11] Patent Number: 4,790,219

[45] Date of Patent: Dec. 13, 1988

[54] HANDLED RATCHET-BREAKER BAR TOOL

[76] Inventor: Kenneth L. Will, 5621 Beaver Trail, Indianwoods, Evansville, Ind. 47715

[21] Appl. No.: 908,727

[22] Filed: Sep. 18, 1986

[51] Int. Cl.[4] ..... B25B 13/46; B25G 1/04; B25G 1/06

[52] U.S. Cl. ..... 81/63; 81/63.2; 81/177.8; 81/177.9

[58] Field of Search ..... 81/62, 63, 63.1, 63.2, 81/177.8, 177.9

[56] References Cited

U.S. PATENT DOCUMENTS

| | | | |
|---|---|---|---|
| 928,003 | 7/1909 | Peterson | 81/177.6 |
| 4,406,186 | 9/1983 | Gummow | 81/60 |
| 4,475,420 | 10/1984 | Atkinson et al. | 81/58.3 |
| 4,520,697 | 6/1985 | Moetteli | 81/62 |

FOREIGN PATENT DOCUMENTS

| | | | |
|---|---|---|---|
| 550038 | 12/1942 | United Kingdom | 81/177.9 |

*Primary Examiner*—Frederick R. Schmidt
*Assistant Examiner*—William E. Terrell
*Attorney, Agent, or Firm*—Warren D. Flackbert

[57] ABSTRACT

A handled ratchet-breaker bar tool characterized by the provision of one or two elongated pivotal handles which permit tool usage at usually remote locations. A removable knob is included for added pressure application at the job site, where the length of the assembly for such knob is adjustable. Additionally, a ratchet directional control is effectively arranged for ready operator usage. Moreover, the instant tool is easily converted to satisfy a variety of nut/bolt tightening and/or loosening requirements.

2 Claims, 1 Drawing Sheet

HANDLED RATCHET-BREAKER BAR TOOL

As is known, mechanics oftentimes encounter difficulty in effectively tightening and/or loosening a nut or a headed bolt due to, for example, location, i.e. remoteness or inaccessability; and, corrosion, resulting from installation conditions, use environment, and/or wearing. A need has become apparent, therefore, for a tool which effectively overcomes problems of the aforementioned nature.

Accordingly, and in this connection, the invention presents a handled tool serving either ratchet or breaker bar purposes, where, with the basic unit, a variety of working tool forms can be achieved as, for example, a simple breaker bar; a simple ratchet; a speed knob; an adjustable one or two-handled breaker bar; and, an adjustable one or two-handled ratchet. With the preceding, a square drive is presented which, in combination with a conventional socket, serves positive operational purposes.

In addition to end use, other features may be made part of the invention, including, also by way of example, the provision of an adjustable extension handle, a lighting system, and an arrangement for hand protection. In other words, the instant tool, readily carried by a mechanic, achieves immediate and positive utility for a variety of job requirements.

In any event, a better understanding of the present invention will become more apparent from the following description, taken in conjunction with the accompanying drawing, wherein

Figure 1:
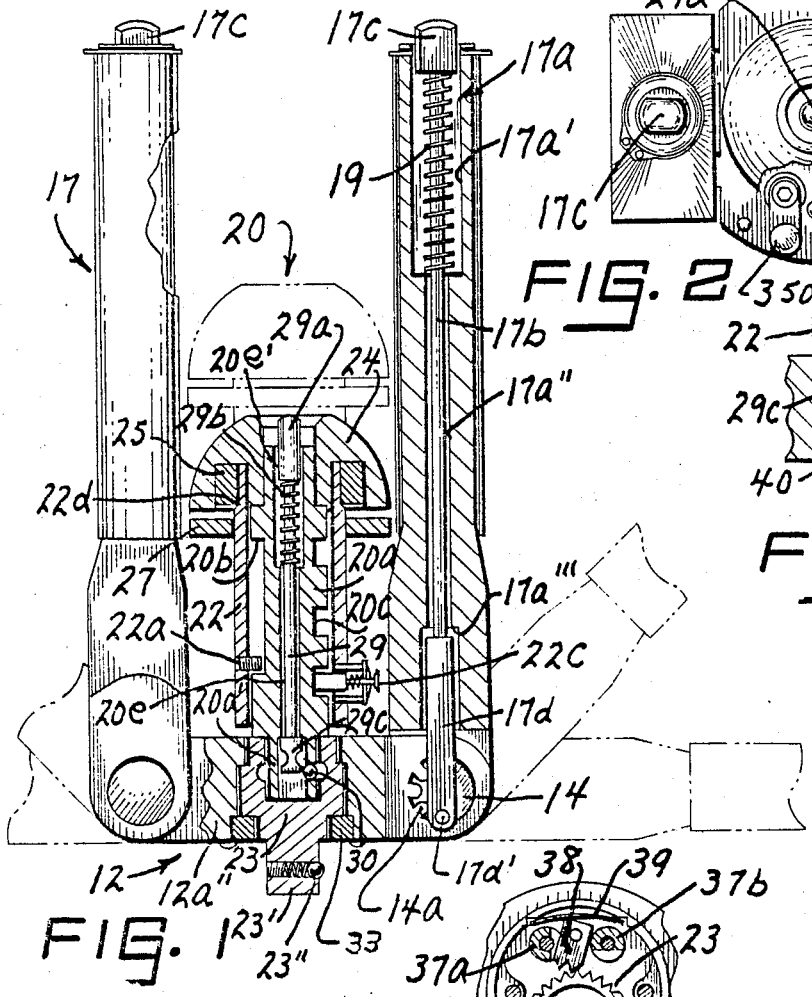
FIG. 1 is a view in side elevation, partly fragmentary and partly in vertical section, showing a handled ratchet-breaker bar tool in accordance with the teachings of the present invention, in this instance disclosing a ratchet application, where the phantom lines represent the handles in various alternative operating positions.
Figure 2:
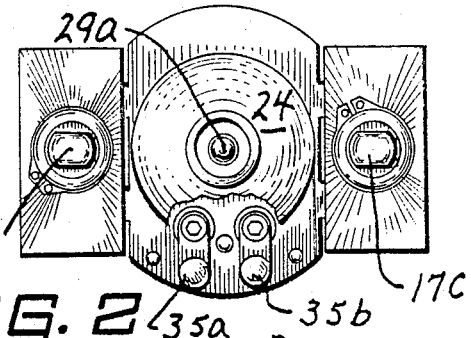
FIG. 2 is a top plan view, looking downwardly on the invention form of FIG. 1.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 3A:
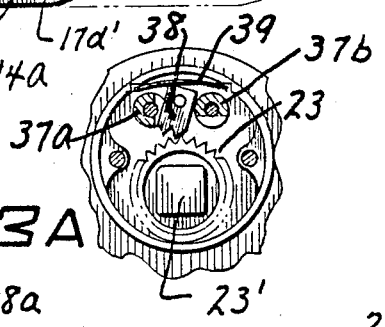
FIG. 3A is a fragmentary bottom view of the ratchet directional control in a first operative position.
Figure 3:
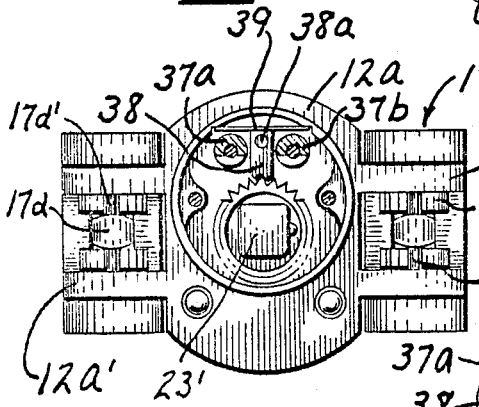
FIG. 3 is a bottom plan view of the invention form of FIG. 1, detailing the ratchet direction control, where, in this instance, such is at a locked position.
Figure 3B:
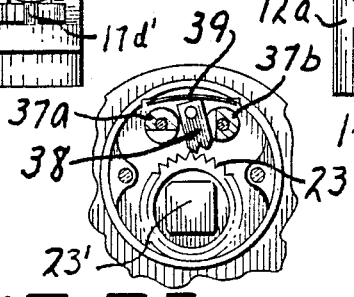
FIG. 3B is a fragmentary bottom view of the ratchet directional control in a second operative position.
Figure 4:
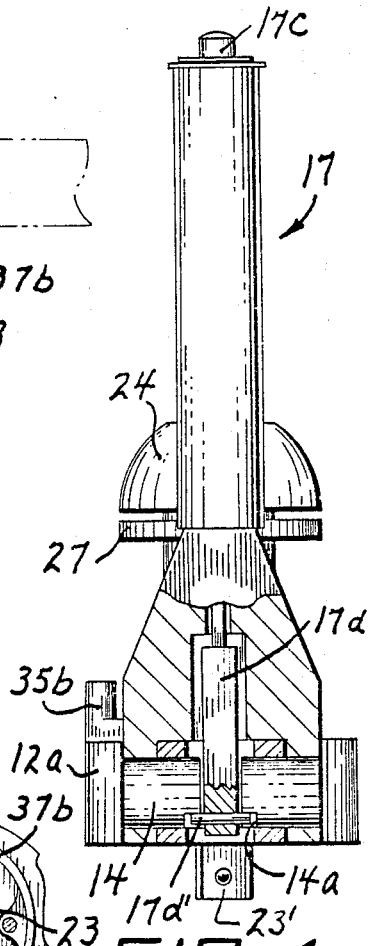
FIG. 4 is a view in side elevation of the invention form of FIG. 1, looking from right to left in FIGS. 1–2; and, FIG. 5 is a fragmentary detailed view of the tool of FIG. 1, but modified for breaker bar usage.

Referring now to the figures, and particularly to FIGS. 1, 2, 3, and 4, a handled ratchet tool 12 form of the invention is disclosed, including a base 12*a* having pairs of arms 12*a*′ extending from opposite sides thereof, where dowel pins 14 are received within openings in each of the pairs of arms 12*a*′ (see FIGS. 3 and 4). The inner end of each dowel pin 14 includes notches or cut-out portions 14*a* (see FIG. 1) for reasons to be detailed herebelow.

An elongated handle 17 is pivotally arranged on the dowel pins 14, i.e. dowel pins 14 also extend through openings in the base thereof (see FIG. 4). Each handle 17 is selectively movable to accommodate use requirements and, for example, may assume the solid line and the phantom line positions of FIG. 1.

The selective pivotal movement of each handle 17 is accomplished by mechanism extending through an axial passageway 17*a* within the entire length of the handle 17. The passageway 17*a* is defined by an enlarged upper portion 17*a*′, a reduced diameter center portion 17*a*″ and a slightly enlarged lower portion 17*a*‴. An elongated control member 17*b* having a hand-operated button 17*c* at its upper end extends through passageway 17*a*, terminating by an enlargement 17*d* at its lower end. The enlargement 17*d* includes a pin 17*d*′ laterally extending from opposite sides thereof (particularly evident in FIGS. 1, 3 and 4) and selectively engageable with the corresponding notches or cut-out portions 14*a* in the dowel pins 14 in a locking relationship. The assembly is completed by a spring member 19 which encircles the control member 17*b* in the enlarged upper portion 17*a*′ of the passageway 17*a*.

In use, and in order to accomplish the selective positioning of the elongated handle 17, the button 17*c* is urged downwardly against the force of the spring member 19, causing downward movement of the control member 17*b* and, as well, movement of the pin 17*d*′ out of any given notch or cut-out portions 14*a* in the dowel pins 14. In other words, the handle 17 can be rotated to any desired position, where, once the latter has been reached, the handle 17 is locked into such position by the release of the button 17*c* and movement of the pin 17*d*′ into the appropriate corresponding notches or cut-out portions 14*a*.

In view of the length of the handle 17, the desired tool of the invention can operatively and easily reach a work site which, normally, may be relatively inaccessible to the user. Moreover, and as stated, any tool form may include two handles, as shown, or a single handle, depending upon needs.

The aforedescribed invention form includes a speed knob 20 for selective use by the operator in connection with a particular job requirement, i.e. and by way of example, where extra pressure is needed for nut and/or bolt removal. Typically, the speed knob 20 is releaseable, where the solid line showing thereof, in FIG. 1, demonstrates a use position, and the phantom line showing illustrates a position during removal.

In any event, the speed knob 20 operatively connects a rotatable gear 23 disposed in the mid-area 12*a*″ of the base 12*a* and seated on a press fit plate member 33 (see FIG. 1). The gear 23 presents, at its lower end, a square drive 23′, including a conventional spring-urged ball detent or lock 23″, where the latter is adapted to receive and position a conventional socket (not shown) which engages the nut and/or bolt requiring attention.

Detailing the speed knob 20, and again referring to FIG. 1, the assembly thereof includes an elongated body 20*a* having a reduced diameter bottom end 20*a*′ (received within an opening or recess in rotatable gear 23); a longitudinal groove 20*b* along a portion of its outer surface; and, cut-outs 20*c* along another portion of its outer surface. A passageway 20*e* extends axially through the length of the elongated body 20*a*.

The arrangement further includes a sleeve 22 encircling a portion of the elongated body 20*a*, such positioning a set screw 22*a* which travels along groove 20*b* to maintain the sleeve 22 in alignment and a spring-urged pull pin 22*c* which selectively engages a desired cut-out 20*c* for accommodating speed knob 20 length and/or use requirements.

A rounded knob member 24 is disposed on a roller bearing 25 seated in a reduced diameter portion or neck 22*d* of the sleeve 22. A circular plate or disc 27 is secured to the sleeve 22 beneath the knob member 24, serving to permit hand rotation of the speed knob 20, as for "snugging" a nut prior to full tightening through handle 17 usage.

In order to release/remove the speed knob 20 from the rotatable gear 23, a shaft 29 extends through passageway 20*e*, such including a quick-release button 29*a* at its upper end extending into an enlarged portion 20*e*' of passageway 20*e* and normally urged into an operative or locked position by a spring member 29*b* seated within enlarged portion 20*e*'.

The lower end of shaft 29 includes a tip 29*c* defined by a cut-out midportion which selectively receives a ball detent or lock 30 when the shaft 29 is depressed, through button 29*a*, when speed knob 20 removal is desired. During normal usage, and by reason of spring member 29*b*, the ball detent or lock 30 is maintained in a cooperative relationship with a recessed portion (not numbered) in the surface of the recess in the rotatable gear 23 (see FIG. 1, although a "fully" cooperative relationship is not shown). At such time, the top surface of the tip 29*c* bears against a surface created by a reduced diameter portion of passageway 20*e*.

In any event, it should be evident that the preceding described speed knob 20 adds versatility to the tool, i.e. such may or may not be utilized, depending upon needs; the overall length thereof may be readily varied; and, where necessary, such provides for simple hand rotation, as during nut tightening prior to handle 17 usage. Moreover, it should be recognized that the above "quick release" feature is directed to the speed knob 20 and is not concerned with any detachment/removal of the rotatable gear 23 to which it is operatively connected, i.e. the latter remains positioned in the mid-area 12" of the base 12*a*.

Looking now at the presented ratchet mechanism (when the tool form is such), and as particularly shown in FIGS. 2, 3, 3A and 3B, triggers 35*a*–35*b* operationally and selectively control the pivotal movement of dowels 37*a*–37*b* which, in turn, control, either in one direction or the other, free rotational movement of the gear 23 by reason of the position of a pivotal, on pin 38*a*, ratchet lever 38 (depending upon desired usage). In this connection, FIGS. 3, 3A and 3B respectively illustrate a locked gear 23 position; a position of dowels 37*a*–37*b* which permits counterclockwise gear 23 rotation, as for loosening; and, a position of dowels 37*a*–37*b* which permits clockwise gear 23 rotation, as for tightening (both of the latter when viewed as presented).

The provision of a ratchet lever return plate 39—which is made from a flexible material—serves to urge the ratchet lever 38 to the position of FIG. 3 during usage and to maintain such at the normal position of FIG. 3 when the dowels 37*a*–37*b* are operator moved to such. In other words, and depending upon whether bolt/nut loosening or tightening is demanded, the ratchet lever 38 successively returns to the position of FIG. 3 during usage.

Figure 5:
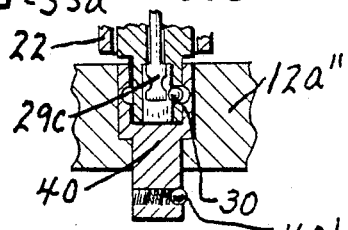

Thus, still further versatility is afforded by the tool of the invention, to-wit, an effective ratchet mechanism which serves locking and/or directional usage control. In the event the tool is to satisfy breaker needs, reference is drawn to FIG. 5, where like reference numerals identify like components to those mentioned above. The basic difference is the omission of gear 23—in its place, ball or detent lock 30' is cooperative with a fixed insert member 40 (which also includes a spring-urged ball or detent lock 40' for securement with a socket—not shown). The same selective removal arrangement with the speed knob 20 is provided. One or two pivot handles 17 may be utilized with this invention form.

It should be evident from the preceding that the instant tool affords a variety of end usages, being readily adaptable to changes in form so as to satisfy a particular need, as in connection with ratchet or breaking purposes. The elongated handles 17 permit utility at remote nut/bolt loosening and/or tightening locations, and with added operational torque. The speed knob 20 serves importance where more pressure is required to accomplish an on-site job, and selective manual rotation of the speed knob 20 permits nut/bolt "snugging" prior to maximum handle controlled tightening.

In any event, the unit described hereabove is susceptible to various changes within the spirit of the invention, including, by way of example, proportioning; material choice; adjustment alternatives; and, the like. Thus, the preceding should be considered illustrative and not as limiting the scope of the following claims:

I claim:

1. In a tool including a base positioning an operating drive at the mid-area thereof, a pair of elongated handles pivotally mounted to and extending from said base at each end and laterally with respect to the longitudinal axis thereof, where each elongated handle is individually positionable in any one of a range of pivotal positions by structure including a spring-urged control member selectively engaging a pin with one of a plurality of cooperating notches, where said operating drive mounts extendible and rotatable knob means which serves to receive manual pressure for application against a workpiece during a use condition, and where said knob means is removable and spring-urged into a mounted position on said operating drive, said knob means including a sleeve, an elongated body received in said sleeve having a plurality of cut-outs therein, and a spring-urged pull-pin in said sleeve for selectively engaging one of said plurality of cut-outs, said elongated body including a spring-urged shaft operating a detent device in said operating drive.

2. In a tool including a base positioning a ratchet mechanism at the mid-area thereof, a pair of elongated handles pivotally mounted to and extending from said base at each end and laterally with respect to the longitudinal axis thereof, where each elongated handle is individually positionable in any one of a range of pivotal positions by structure including a spring-urged control member selectively engaging a pin with one of a plurality of cooperating notches, where said ratchet mechanism includes a rotatable gear presenting a square operating drive, hand operated means for selectively controlling the movement mode of said rotatable gear to be fixed, clockwise or counterclockwise in said base, and where said movement control means includes selectively and independently rotatable dowels, a toothed lever pivotally engaging said rotatable gear, and a resilient plate continually urging said toothed lever toward the location thereof which establishes the fixed mode of said rotatable gear, said dowels selectively engaging said toothed lever to limit its pivotal motion in either or both pivotal directions.

* * * * *